US008402714B2

(12) United States Patent
Labrecque

(10) Patent No.: US 8,402,714 B2
(45) Date of Patent: Mar. 26, 2013

(54) SYSTEM AND METHOD FOR REFURBISHING AN EXISTING CURTAIN WALL

(75) Inventor: Normand Labrecque, Beloeil (CA)

(73) Assignee: Groupe Lessard Inc., Dorval (CA)

( * ) Notice: Subject to any disclaimer, the term of this patent is extended or adjusted under 35 U.S.C. 154(b) by 92 days.

(21) Appl. No.: 12/965,303

(22) Filed: Dec. 10, 2010

(65) Prior Publication Data

US 2011/0138727 A1 Jun. 16, 2011

Related U.S. Application Data

(60) Provisional application No. 61/285,594, filed on Dec. 11, 2009.

(51) Int. Cl.
*E04B 1/00* (2006.01)

(52) U.S. Cl. ..... 52/745.09; 52/235; 52/764; 52/772; 52/775; 52/781

(58) Field of Classification Search ..... 52/235, 52/236.3, 764, 772, 775, 780, 781
See application file for complete search history.

(56) References Cited

U.S. PATENT DOCUMENTS 2,963,126 A * 12/1960 Cudini ..... 52/302.6
3,053,353 A 9/1962 Miller
3,978,629 A * 9/1976 Echols, Sr. ..... 52/235
4,008,552 A * 2/1977 Biebuyck ..... 52/204.591
4,055,923 A * 11/1977 Biebuyck ..... 52/235
4,207,717 A 6/1980 Hubbard
4,214,415 A * 7/1980 Sukolics ..... 52/395
4,531,336 A * 7/1985 Gartner ..... 52/209
4,571,905 A * 2/1986 Kaminaga ..... 52/235
4,608,793 A * 9/1986 Yost et al. ..... 52/235
4,638,613 A 1/1987 Tönsmann
4,672,784 A * 6/1987 Pohlar ..... 52/235
4,680,905 A * 7/1987 Rockar ..... 52/200
4,738,065 A * 4/1988 Crandell ..... 52/235
4,903,454 A * 2/1990 Rose ..... 52/489.1
5,220,759 A 6/1993 Hossli
5,253,459 A * 10/1993 Parinas et al. ..... 52/235
5,355,645 A 10/1994 Farag
5,481,839 A * 1/1996 Lang et al. ..... 52/235
5,579,616 A 12/1996 Farag
5,592,795 A * 1/1997 Rinehart et al. ..... 52/235
5,839,236 A * 11/1998 Frey ..... 52/235
5,893,244 A * 4/1999 Magoon ..... 52/235
6,658,804 B2 * 12/2003 Leytes et al. ..... 52/235
6,804,920 B2 * 10/2004 Hogan ..... 52/235
7,036,280 B2 5/2006 Hogan
7,080,488 B2 * 7/2006 Hocker et al. ..... 52/235
7,587,869 B2 9/2009 Lahni
7,763,334 B2 7/2010 Berkowitz
7,779,584 B2 8/2010 Arias
7,818,931 B2 * 10/2010 Grunewald et al. ..... 52/235
7,818,934 B2 10/2010 Hall et al.

(Continued)

*Primary Examiner* — Brian Glessner
*Assistant Examiner* — Joshua Ihezie
(74) *Attorney, Agent, or Firm* — Ipaxio S.E.N.C.

(57) ABSTRACT

The system includes a plurality of mullion retrofit adaptors, each having a rear side configured and disposed to fit over the front side of at least some mullion of the existing supporting framework. It also includes a plurality of new mullions, each having a rear side configured and disposed to fit over at least some of the retrofit adaptors. A method for refurbishing an existing curtain wall attached to a base structure is also presented. This proposed concept can significantly reduce the time and costs for refurbishing an existing curtain wall.

3 Claims, 23 Drawing Sheets

U.S. PATENT DOCUMENTS

2002/0124499 A1* 9/2002 Braybrook ..... 52/235
2002/0134033 A1* 9/2002 Ishikawa et al. ..... 52/235
2005/0060950 A1* 3/2005 Hauschildt et al. ..... 52/235
2005/0138889 A1* 6/2005 Biebuyck ..... 52/782.1
2005/0284053 A1* 12/2005 Grunewald et al. ..... 52/235
2006/0016137 A1 1/2006 Ferro
2008/0313982 A1 12/2008 Termohlen
2009/0241466 A1* 10/2009 Gussakovsky ..... 52/786.1

* cited by examiner

SYSTEM AND METHOD FOR REFURBISHING AN EXISTING CURTAIN WALL

CROSS REFERENCE

The present case claims priority over U.S. provisional patent application No. 61/285,594 filed 11 Dec. 2009, the content of which is hereby incorporated by reference in its entirety.

TECHNICAL FIELD

The technical field relates generally to curtain walls, more particularly to ways of refurbishing existing curtain walls.

BACKGROUND

A curtain wall generally includes a plurality of juxtaposed panels secured to a supporting framework and which together often form an exterior wall of a building. Each panel can be made of one or more materials, such as glass, metal, stone and many others, depending on the desired architectural aspect and the function of each panel. A curtain wall can have identical panels or have a plurality of different types of panels. These panels are generally connected to beams, called mullions, each mullion being part of the supporting framework of the curtain wall. The supporting framework is itself anchored or otherwise attached to a base structure, for instance a building structure. A curtain wall often spans multiple floors. Other applications and configurations also exist.

Some curtain walls may need to be refurbished after some time. For instance, the owner of a building may want to renew the water-tightness of an existing curtain wall, to refresh its outside esthetical aspect or to improve its heat insulation characteristics. Many other factors may also prompt the owner of a building to refurbish an existing curtain wall.

Some curtain wall refurbishments can require that the existing curtain wail be entirely dismounted before installing a new one. This includes removing the supporting framework of the existing curtain wall by which the other parts of the curtain wall were attached to the base structure. Once the existing supporting framework is removed, a new supporting framework is anchored to the base structure and the other parts of the new curtain wall are installed thereafter. However, the removal of an existing supporting framework and the installation of a new supporting framework can be very labor intensive and time consuming. Also, even when only the panels (for instance glazing units) of an existing curtain wall are being replaced, the thorough cleaning that must be done to remove the previous sealant beads before new panels are installed can be very labor intensive and time consuming.

Room for improvements thus exists in this area of technology.

SUMMARY

In one aspect, there is provided a system for refurbishing an existing curtain wall having a supporting framework, the supporting framework including a plurality of existing mullions exposed on a front side for receiving the system, the system including: a plurality of mullion retrofit adaptors, each having a rear side configured and disposed to fit over the front side of at least some of the existing mullions; and a plurality of new mullions, each having a rear side configured and disposed to fit over at least some of the retrofit adaptors.

In another aspect, there is provided a method for refurbishing an existing curtain wall attached to a base structure, the curtain wall having a plurality of existing mullions forming a plurality of existing panel-receiving areas, the method including: dismounting the existing curtain wall to expose a front side of the existing mullions while leaving them attached to the base structure; mounting retrofit adaptors to the front side of the existing mullions; and mounting new mullions to the retrofit adaptors, the new mullions forming a plurality of new panel-receiving areas, each being adjacent to a corresponding one of the existing panel-receiving areas.

Further details on these aspects as well as other aspects of the proposed concept will be apparent from the following detailed description and the appended figures.

DETAILED DESCRIPTION

Figure 1:
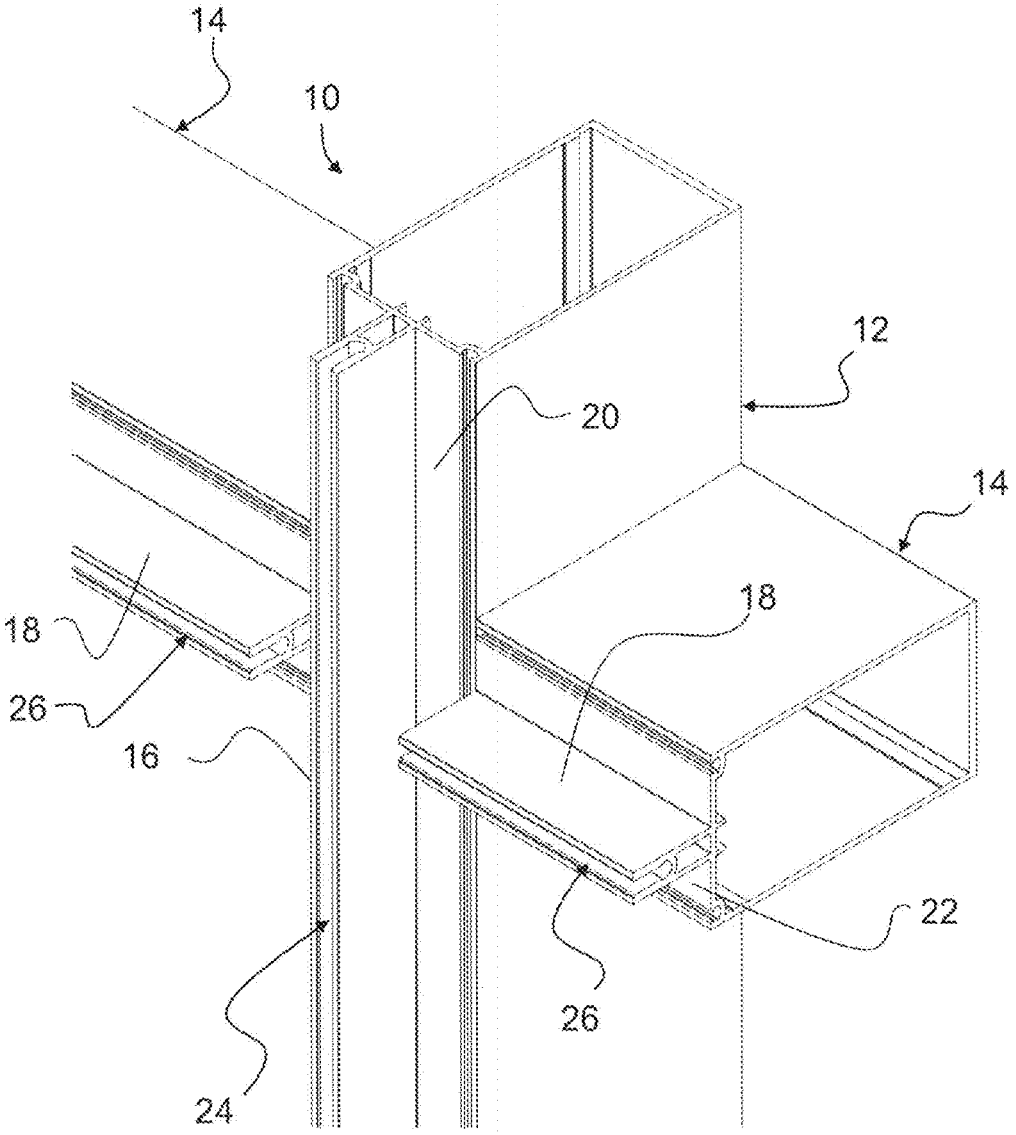
FIG. 1 is an isometric view illustrating an example of a portion of the supporting framework of an existing curtain wall being refurbished.

FIG. 1 is an isometric view illustrating an example of a portion of the supporting framework of an existing curtain wall 10 being refurbished. In the proposed concept, the supporting framework of the existing curtain wall 10 being refurbished is kept in place instead of being dismounted with other parts of the existing curtain wall 10. This supporting framework includes mullions exposed on their front side for receiving a refurbishing system as proposed herein. This way, the time and costs for refurbishing the existing curtain wall 10 can be significantly reduced since most of the supporting framework does not need to be dismounted and replaced.

The illustrated supporting framework includes a plurality of vertical and horizontal existing mullions. One vertical existing mullion 12 and two horizontal existing mullions 14 are shown in FIG. 1. For the sake of clarity, only a portion of the length of the existing mullions 12, 14 are shown in the figures. The existing mullions 12, 14 can be made of aluminum or an alloy thereof. Other materials can also be used as well.

In the illustrated example, the vertical existing mullion 12 has a front flanged portion 16 projecting outwardly from a front wall 20 thereof. The horizontal existing mullion 14 also has a front flanged portion 18 projecting outwardly from a front wall 22 thereof. The front flanged portions 16, 18 extend substantially along the entire length of the existing mullions 12, 14 and each of them includes a corresponding front opened channel 24, 26. These channels 24, 26 are designed to receive fasteners, for instance self-tapping screws or bolts. Originally, the curtain wall 10 included panels. The perimeter of each panel was secured to these vertical and horizontal existing mullions 12, 14. Their front flanged portions 16, 18 generally defined the contours of the areas where these panels were positioned.

Figure 2:
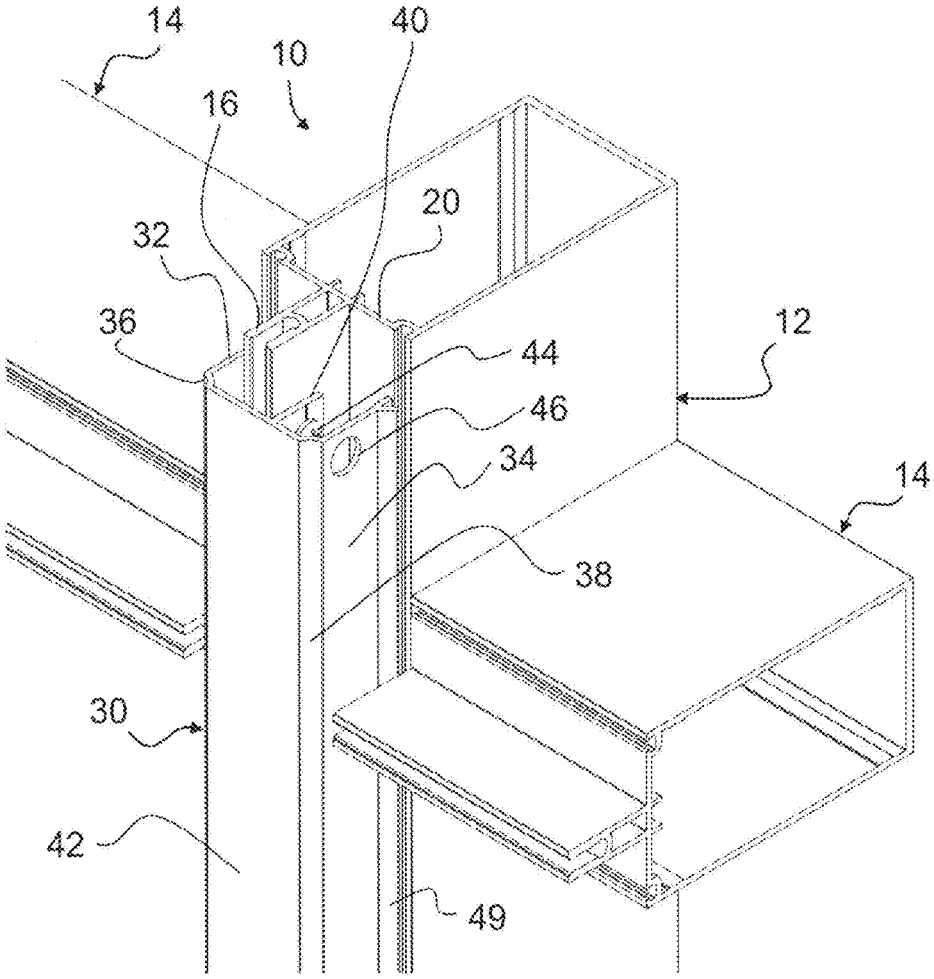
FIG. 2 is an isometric view illustrating an example of a vertical retrofit adaptor inserted on the vertical existing mullion shown in FIG. 1.
Figure 3:
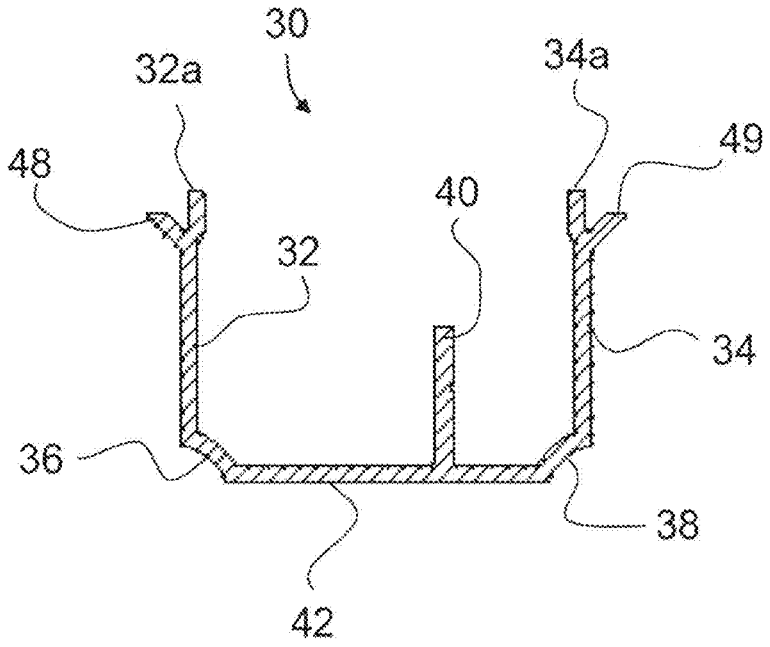
FIG. 3 is an enlarged transversal cross-sectional view of the vertical retrofit adaptor shown in FIG. 2.

The system for refurbishing the existing curtain wall 10 includes a plurality of mullion retrofit adaptors, each having a rear side configured and disposed to fit over the front side of at least one of the existing mullions 12, 14. In the illustrated example, vertical retrofit adaptors 30 are provided to fit on the vertical existing mullions 12. FIG. 2 is an isometric view illustrating an example of a vertical retrofit adaptor 30 inserted on the vertical existing mullion 12 shown in FIG. 1. FIG. 3 is an enlarged transversal cross-sectional view of the vertical retrofit adaptor 30 shown in FIG. 2.

The illustrated vertical retrofit adaptor 30 can be made of a rigid material, for instance aluminum or the like, and has a substantially U-shaped cross section. It includes side walls 32, 34 having rear edges 32*a*, 34*a* (FIG. 3) engaging the front wall 20 of the vertical existing mullion 12 once the vertical retrofit adaptor 30 is mounted thereon. The vertical retrofit adaptor 30 also includes concave corner walls 36, 38, each longitudinally extending between a front wall 42 and a corresponding one of the opposite side walls 32, 34.

The illustrated vertical retrofit adaptor 30 is smaller in width than the vertical existing mullion 12. It has an interior wall 40 that projects at the rear of its front wall 42 and that longitudinally extends about halfway inside the vertical retrofit adaptor 30. This interior wall 40 is configured and disposed to laterally engage one side of the front flanged portion 16 of the vertical existing mullion 12 once the vertical retrofit adaptor 30 is mounted thereon.

Once in position, the vertical retrofit adaptor 30 can be rigidly connected to the vertical existing mullion 12. In the illustrated example, this includes using a plurality of spaced-apart screws 44, one of which is shown in FIG. 2. The screws 44 secure the interior wall 40 of the vertical retrofit adaptor 30 to the front flanged portion 16 of the vertical existing mullion 12. Access holes 46 are provided through the side wall 34 of the illustrated vertical retrofit adaptor 30. These access holes 46 are used to install the screws 44 and, if required, to machine a pilot hole before installing each screw 44. Other kinds of fasteners and arrangements are also possible.

In the illustrated example, and as best shown in FIG. 3, the vertical retrofit adaptor 30 further includes longitudinally-extending and obliquely-disposed side flanges 48, 49, each positioned adjacent to a corresponding rear edge 32*a*, 34*b* of the side walls 32, 34. The purpose of these flanges 48, 49 will be explained later in the text.

Figure 4:
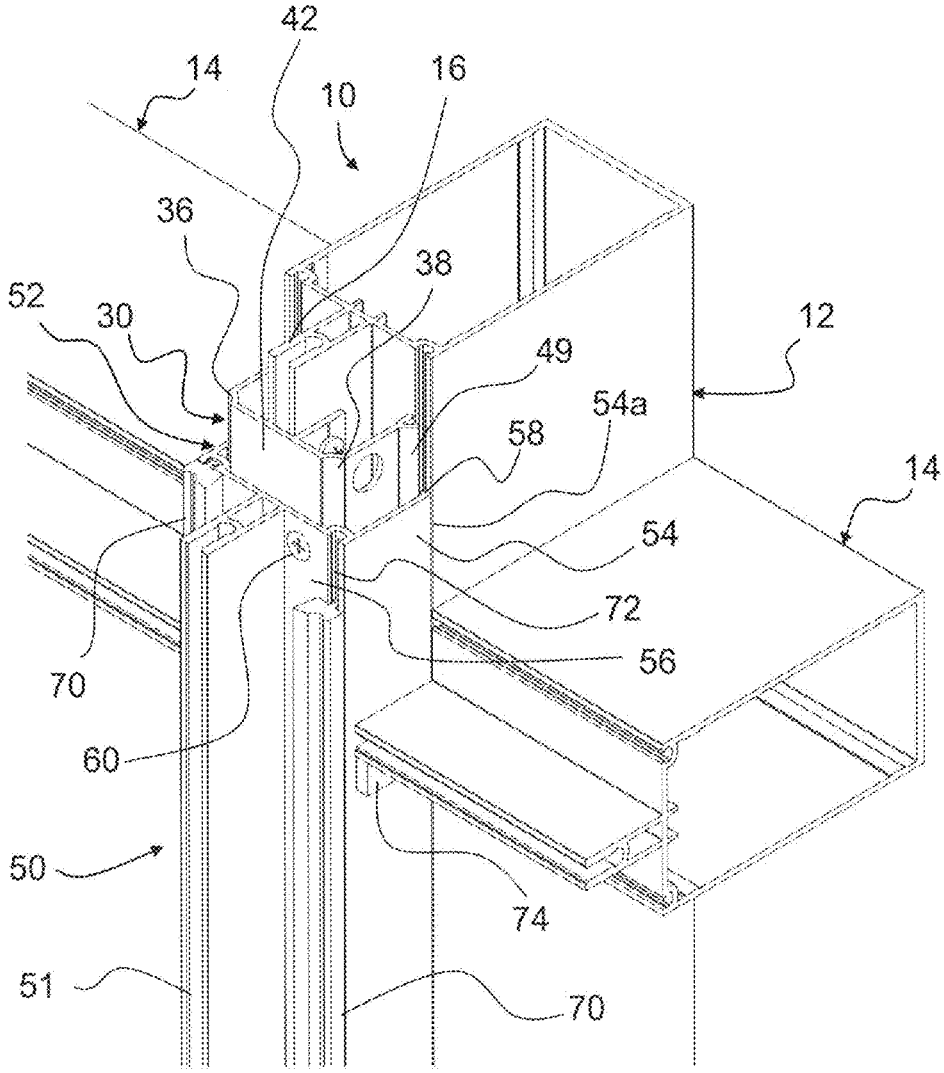
FIG. 4 is an isometric view illustrating an example of a vertical new mullion inserted on the vertical retrofit adaptor shown in FIG. 2.

The system includes a plurality of new mullions, each having a rear side configured and disposed to fit over at least one of the retrofit adaptors. FIG. 4 is an isometric view illustrating an example of a vertical new mullion 50 inserted on the vertical retrofit adaptor 30 shown in FIG. 2. In this example, the vertical new mullion 50 has a front flanged portion 51 that is similar in shape to the front flanged portion 16 of the vertical existing mullion 12. However, one can use a vertical new mullion having a different front portion. In some cases, the front portion can even be omitted.

The vertical new mullion 50 includes opposite side walls 52, 54 and a front wall 56. They form the base portion of the vertical new mullion 50. This base portion fits over the vertical retrofit adaptor 30. Still, as shown in FIG. 4, the side wall 54 includes an interior lip 58 that is adjacent to a rear edge 54*a* of the vertical new mullion 50. The interior lip 58 engages the free end of the corresponding side flange 49 on the vertical retrofit adaptor 30. A similar arrangement is provided in the other side, allowing the vertical new mullion 50 to be snap-fitted over the vertical retrofit adaptor 30.

The illustrated vertical new mullion 50 is also rigidly connected to the vertical retrofit adaptor 30 using a plurality of spaced-apart screws 60, one of which is shown in FIG. 4. The screws 60 are inserted through the front wall 56 of the vertical new mullion 50 and the front wall 42 of the vertical retrofit adaptor 30. Other kinds of fasteners and arrangements are also possible.

FIG. 4 further shows an example of a vertically-extending gasket 70 against which the rear peripheral edges of a panel will rest. Two gaskets 70 are shown in FIG. 4. Each of these gaskets 70 includes a rear flange inserted into a corresponding groove 72 provided on the front wall 56 of the vertical new mullion 50. The grooves 72 are formed by rear deviations in opposite corner portions of the front wall 56. In the illustrated example, the concave corner walls 36, 38 of the vertical retrofit adaptor 30 provide room to accommodate the rear side of these corner portions.

Figure 5:
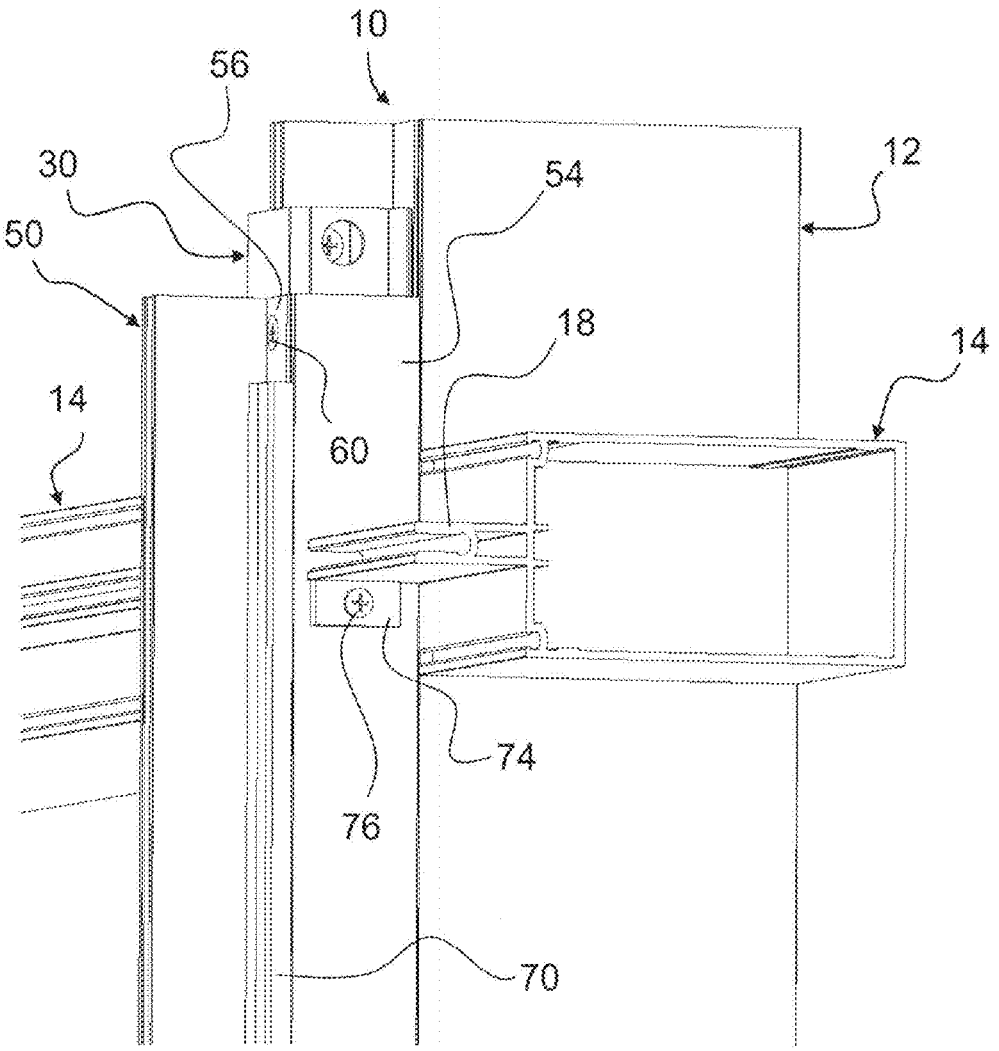
FIG. 5 is an isometric view illustrating the parts shown in FIG. 4 from another angle.

FIG. 5 is an isometric view illustrating the parts shown in FIG. 4 from another angle. It shows that at the end of the horizontal existing mullion 14, the bottom side of its front flanged portion 18 can be supported using a reinforcement block 74 attached to the side wall 54 of the vertical new mullion 50. The block 74 is partially visible in FIG. 4. In the illustrated example, the block 74 is secured using a screw 76 inserted through the side wall 54. A similar arrangement is provided on the other side of the vertical new mullion 50. Other kinds of fasteners and arrangements are also possible.

Figure 6:
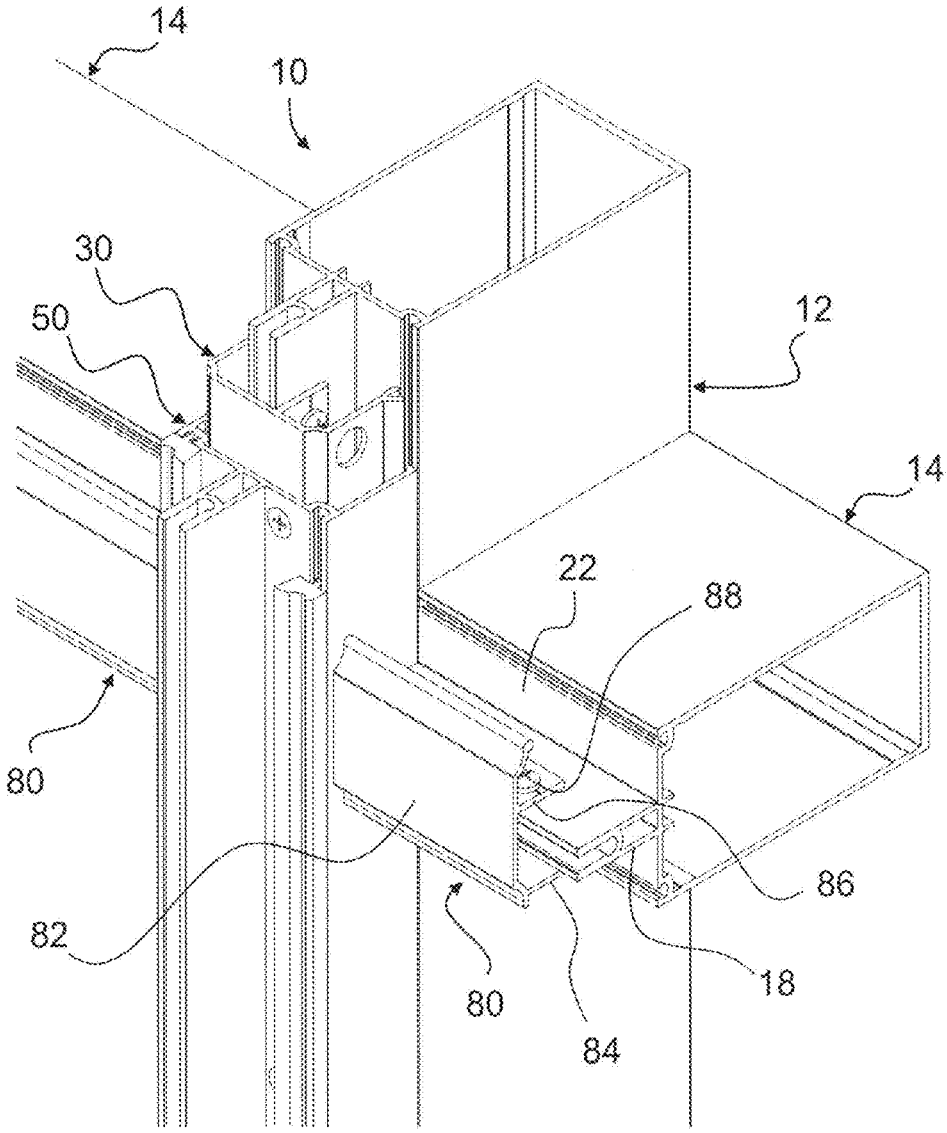
FIG. 6 is an isometric view illustrating an example of horizontal retrofit adaptors inserted on the horizontal existing mullions shown in FIG. 1.

FIG. 6 is an isometric view illustrating an example of a horizontal retrofit adaptor 80. Two of them are inserted on the horizontal existing mullions 14 shown in FIG. 1. Each horizontal retrofit adaptor 80 includes a front wall 82 and two rear walls 84, 86. The horizontal retrofit adaptors 80 are connected to the front flanged portion 18 of the horizontal existing mullions 14 using the horizontal wall 86 perpendicularly projecting from the rear side of the front wall 82 and laterally engaging a top side of the front flanged portion 18. The bottom rear wall 84 extends up to the front wall 22 of the corresponding horizontal existing mullion 14.

The illustrated horizontal retrofit adaptors 80 are rigidly connected to the horizontal existing mullions 14 using a plurality of spaced-apart screws 88, one of which is shown in FIG. 6. The screws 88 attach the uppermost rear wall 86 of each horizontal retrofit adaptor 80 to the front flanged portion 18 of the corresponding horizontal existing mullion 14. Other kinds of fasteners and arrangements are also possible.

Figure 7:
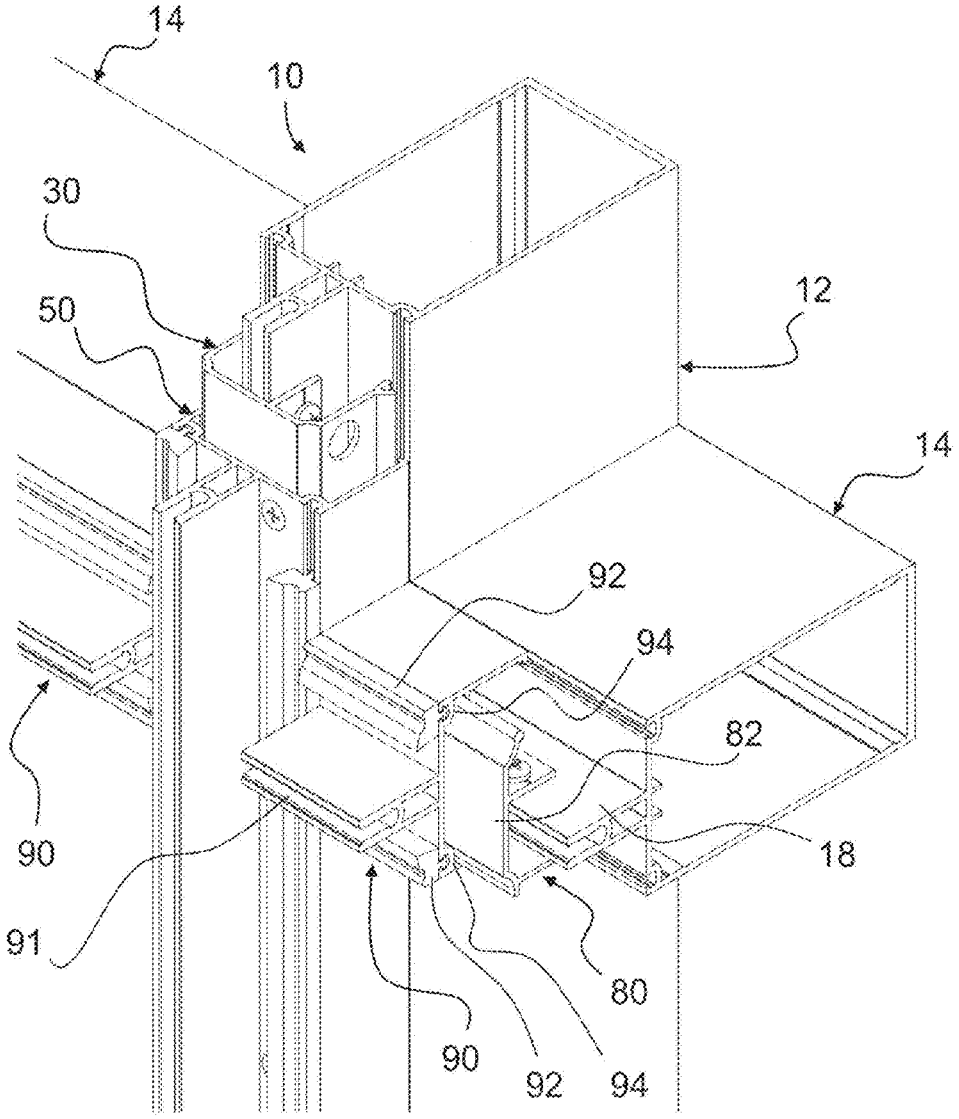
FIG. 7 is an isometric view illustrating an example of a horizontal new mullion inserted on the horizontal retrofit adaptors shown in FIG. 6.

FIG. 7 is an isometric view illustrating an example of a horizontal new mullion 90. Two of them are inserted on the horizontal retrofit adaptors 80 shown in FIG. 6. Each includes a front flanged portion 91 that is similar in shape to the front flange portion 18 of the horizontal existing mullions 14. However, one can also use a horizontal new mullion having a different front portion. Other configurations and arrangements are possible as well.

FIG. 7 also shows an example of gaskets 92 that can be connected to the horizontal new mullion 90. Two gaskets 92 are shown in FIG. 7. Each of these gaskets 92 includes a rear flange inserted into a corresponding front groove 94 provided on the horizontal new mullions 90. The front wall 82 of the horizontal retrofit adaptor 80 is shaped to provide room for the rear side of the grooved portions of the horizontal new mullions 90.

Figure 8:
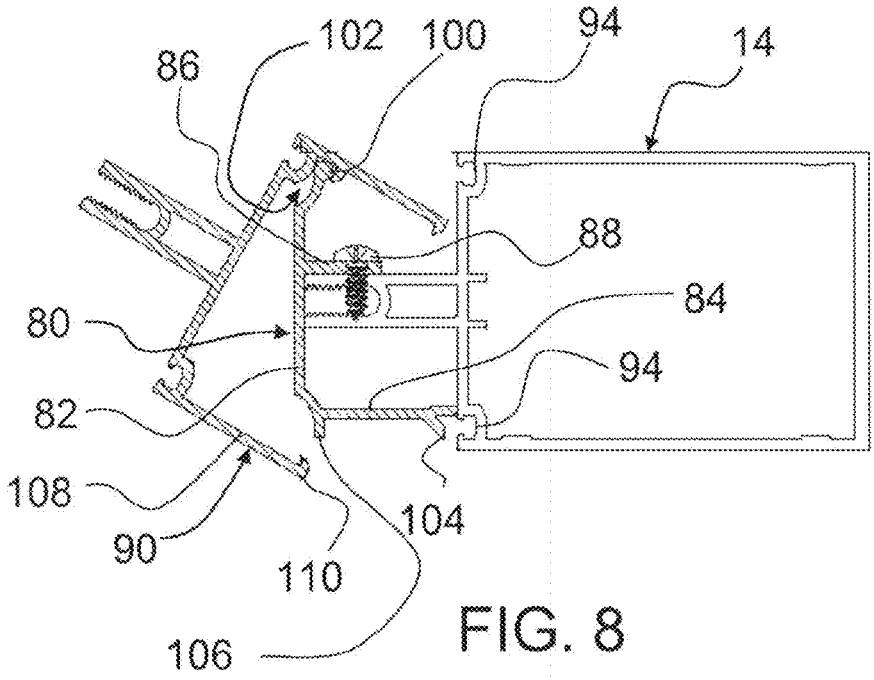
FIGS. 8 and 9 are end views illustrating how each horizontal new mullion shown in FIG. 7 can be installed on a corresponding one of the horizontal retrofit adaptors shown in FIG. 6.
Figure 9:
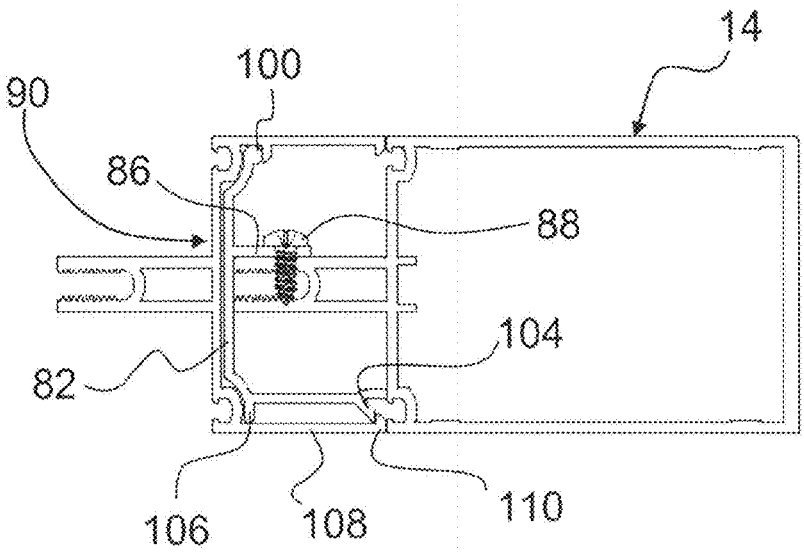

FIGS. 8 and 9 are end views illustrating how each horizontal new mullion 90 shown in FIG. 7 can be installed on a corresponding one of the horizontal retrofit adaptors 80 shown in FIG. 6. As can be seen, the front wall 82 of the illustrated horizontal retrofit adaptor 80 has a rounded top edge 100. The top edge 100 is configured and disposed to be set into an interior channel 102 extending within the horizontal new mullion 90. The horizontal new mullion 90 can then be pivoted around the top edge 100. Furthermore, the illustrated horizontal retrofit adaptor 80 includes two spaced-apart bottom side walls 104, 106. The horizontal new mullion 90 includes a bottom side wall 108 having an interior lip 110 configured and disposed to engage the free end of the wall 104, thereby creating a snap-fit engagement therewith. The wall 106 provides support for the back of the horizontal new mullion 90.

Figure 10:
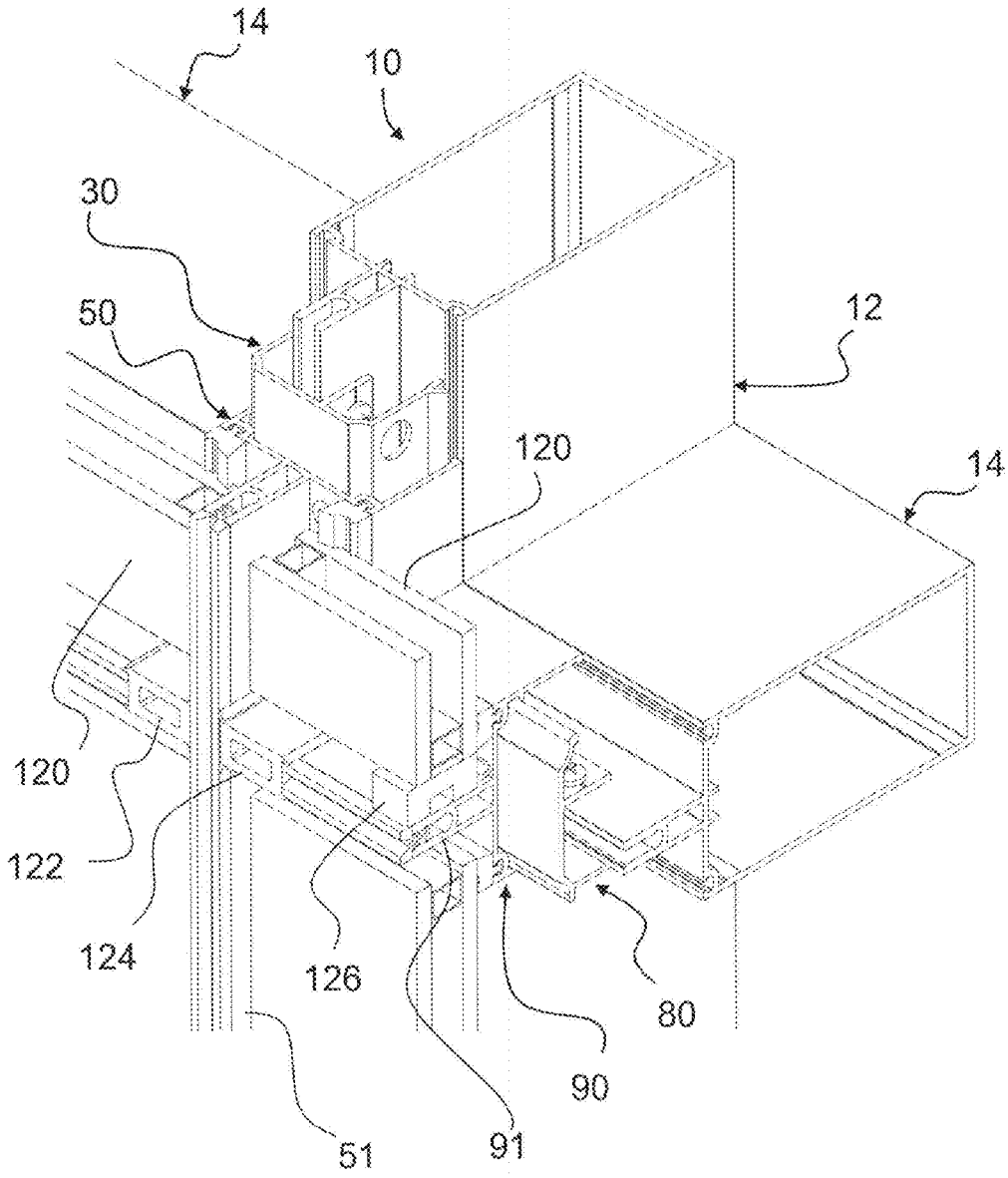
FIG. 10 is an isometric view illustrating an example of a set of panels inserted between the vertical and horizontal new mullions shown in FIGS. 4 and 7.

FIG. 10 is an isometric view illustrating an example of a set of panels 120 inserted between the vertical and horizontal new mullions 50, 90 shown in FIGS. 4 and 7. As can be seen, resilient corners pieces 122, 124 are provided to close the spaces between the side of the front flanged portions 51 of the vertical new mullions 50 and the end of the front flanged portions 91 of the horizontal new mullions 90. Spaced-apart shims 126 are also provided under the panels 120 to prevent them from directly contacting the front flanged portions 91 of the horizontal new mullions 90.

Figure 11:
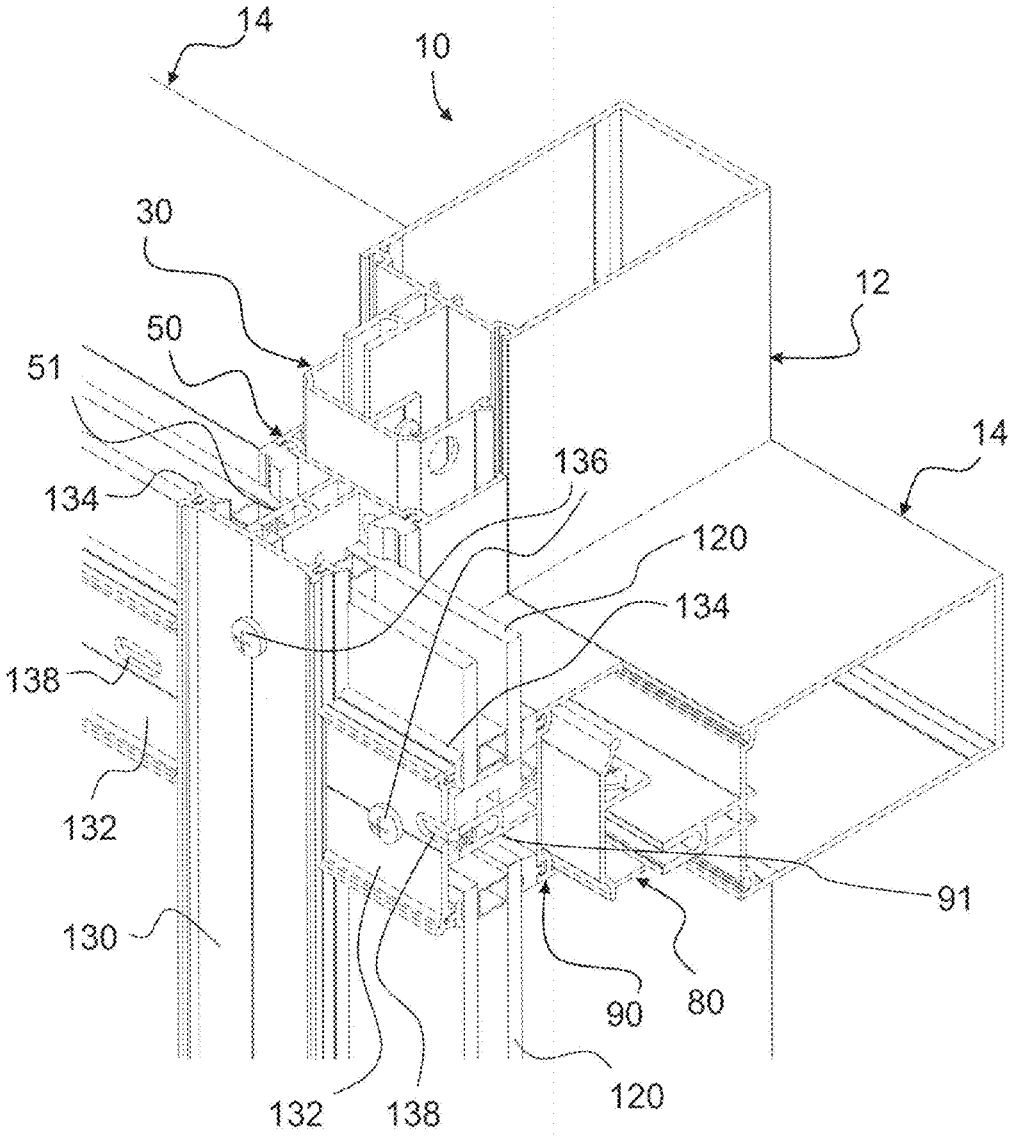
FIG. 11 is an isometric view illustrating an example of a set of pressure plates for retaining the panels shown in FIG. 10.

FIG. 11 is an isometric view illustrating an example of a set of pressure plates 130, 132 for retaining the panels 120 shown in FIG. 10. The illustrated example shows one vertical pressure plate 130 and two horizontal pressure plates 132. Each pressure plate 130, 132 includes opposite gaskets 134 on their rear side and engages simultaneously two adjacent panels 120. The pressures plates 130, 132 are attached to the front flanged portions 51, 91 of the new mullions 50, 90 using fasteners, for instance screws 136 as shown in the example, inserted into the channels of the front flanged portions 51, 91. Other kinds of fasteners and other arrangements are also possible.

Four pressure plates 130, 132 similar to the ones illustrated in FIG. 11 would be provided all around the perimeter of each panel 120, two disposed horizontally and two disposed vertically. Together, these pressure plates 130, 132 cover substantially the entire space around the perimeter of each panel 120 so as to secure it to the new mullions 50, 90. Expansion joints can be provided between at least some of the pressure plates 130, 132 to compensate for the thermal dilatation of the materials and the sway of the building, for instance. Other configurations and arrangements are also possible. Weep holes 138 are provided on the illustrated horizontal pressure plates 132.

Figure 12:
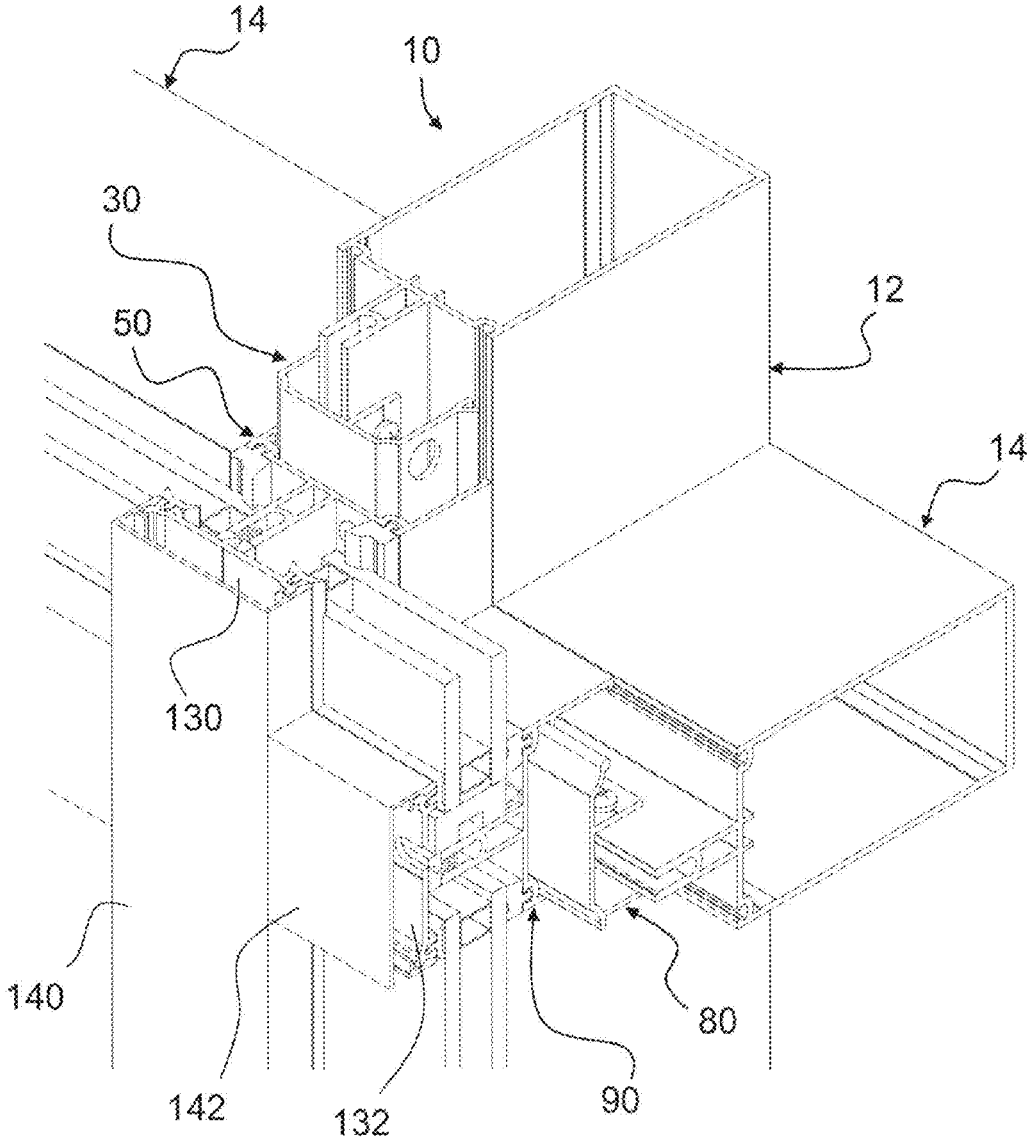
FIG. 12 is an isometric view illustrating an example of a set of covers connected over the pressure plates shown in FIG. 11.

FIG. 12 is an isometric view illustrating, an example of a set of covers 140, 142 connected over the pressure plates 130, 132 shown in FIG. 11. The illustrated covers 140, 142 have a substantially U-shaped cross section and be can snap-fitted over the longitudinal sides of the pressure plates 130, 132. Other configurations and arrangements are possible.

Figure 13:
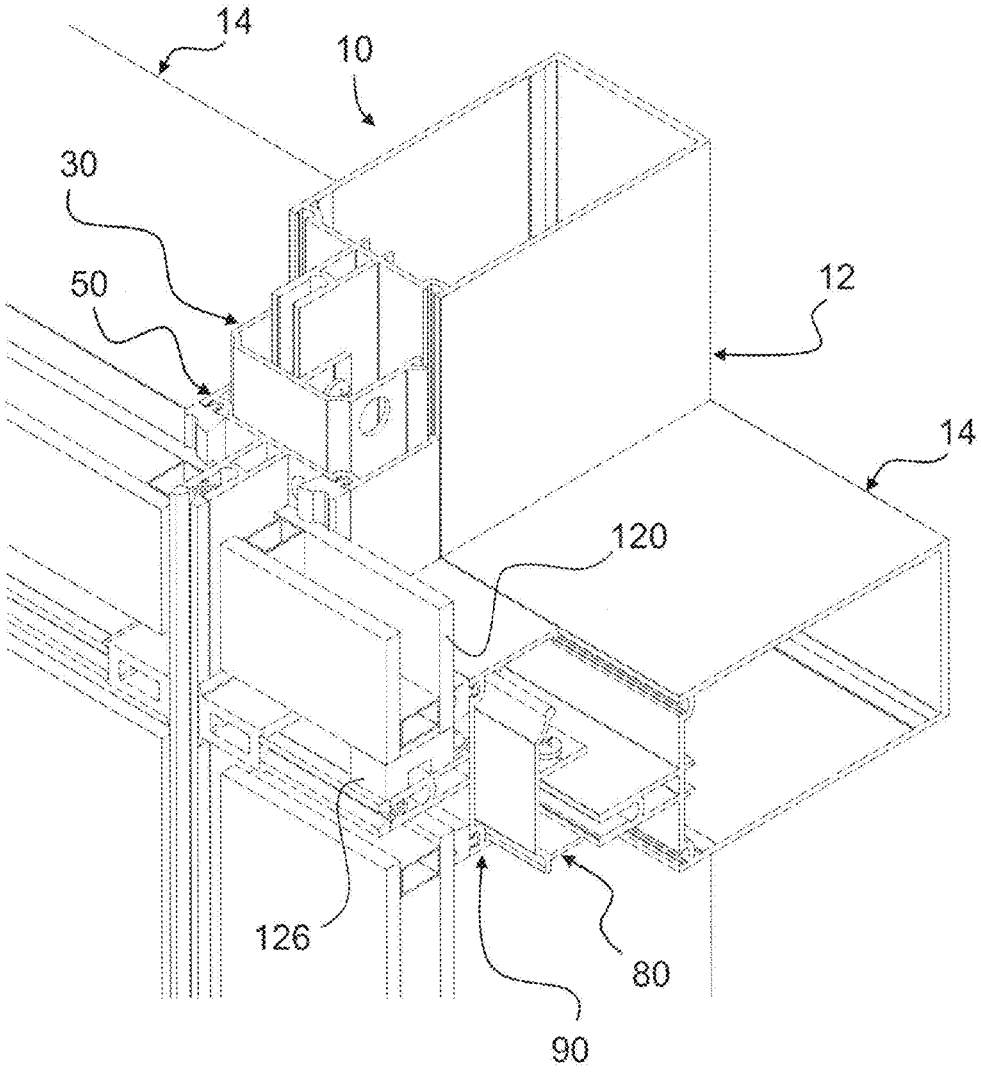
FIGS. 13 to 15 are views similar to FIGS. 10 to 12, respectively, and illustrate another example of arrangement for retaining the panels.
Figure 14:
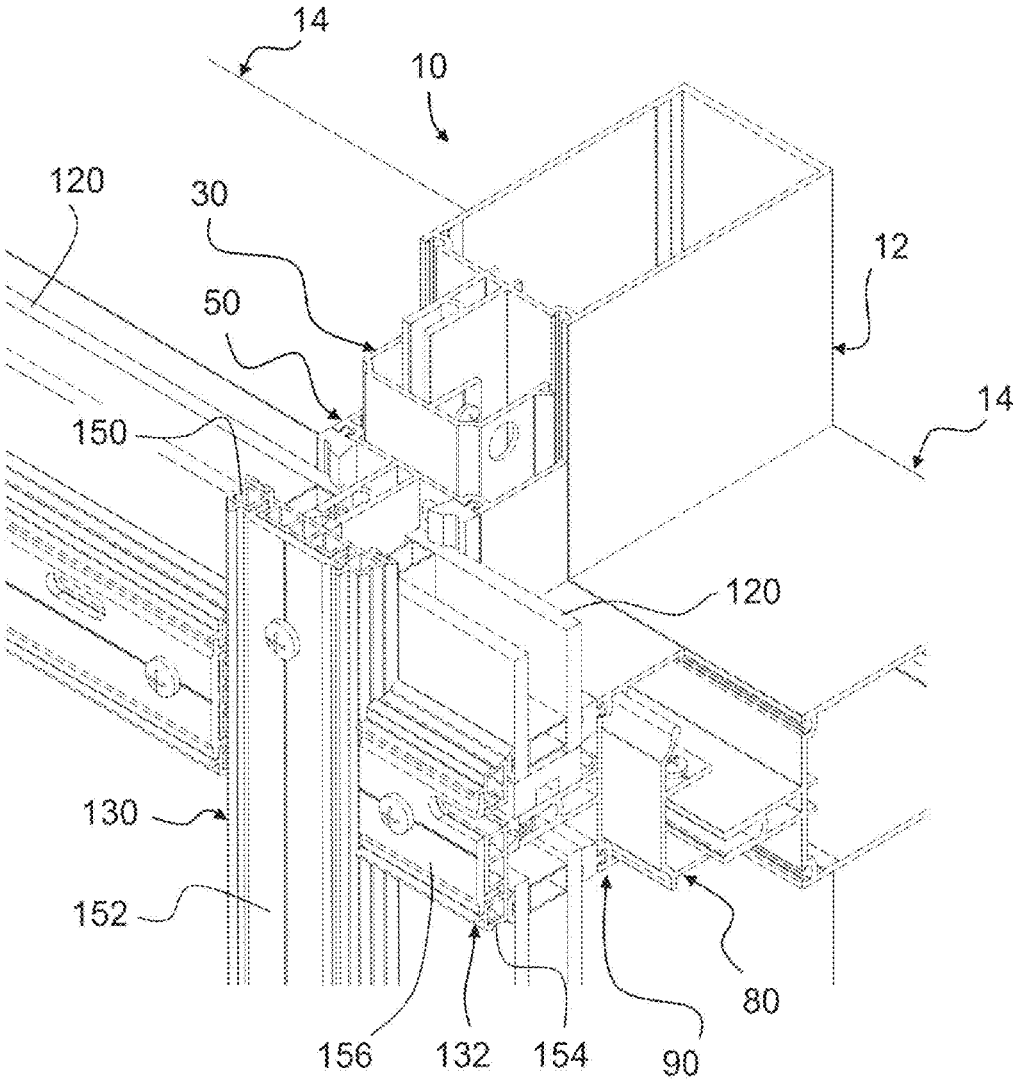
Figure 15:
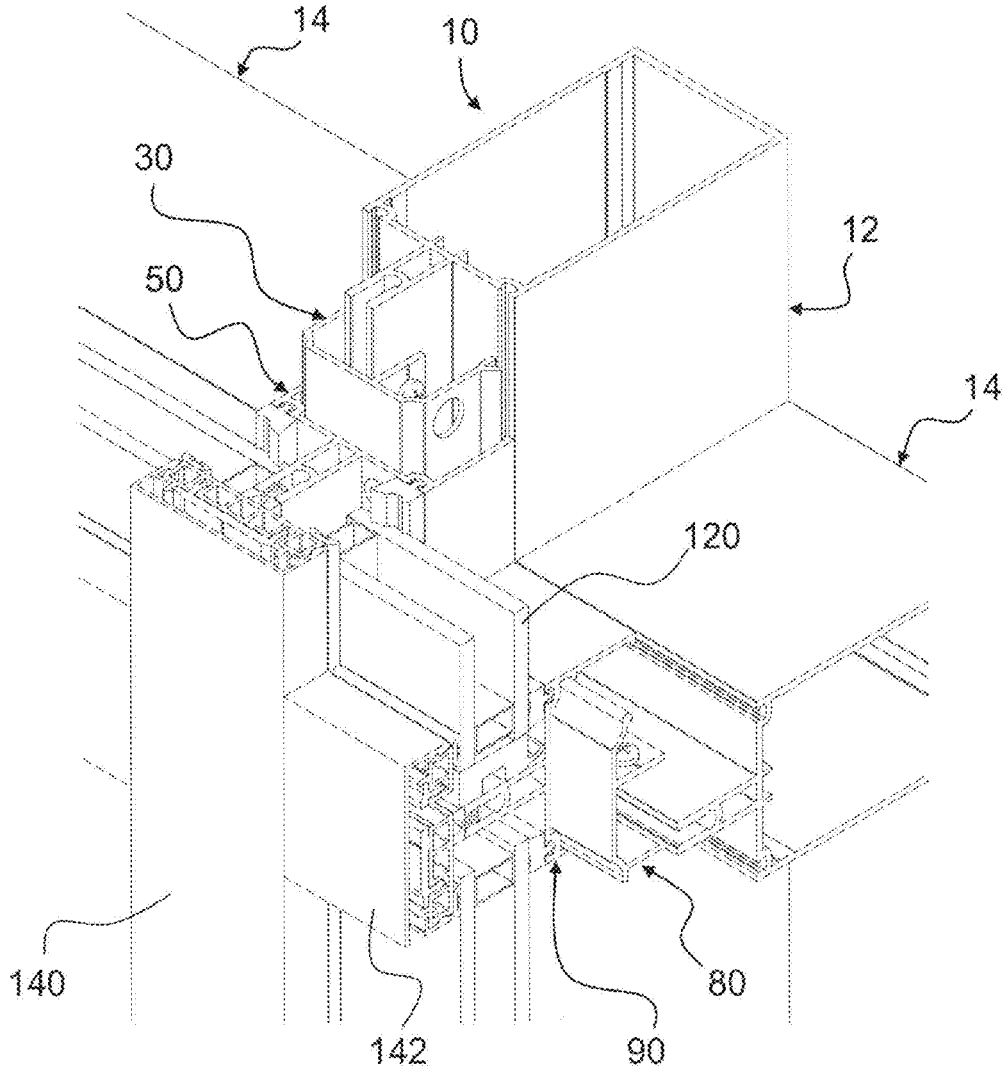

FIGS. 13 to 15 are views similar to FIGS. 10 to 12, respectively, and illustrate another example of arrangement for retaining the panels 120. As can be seen, the shims 126 under the panels 120 are positioned slightly differently and a different kind of pressure plates 130, 132 is used. These pressure plates 130, 132 can be such as those disclosed in U.S. Published Patent Application No. 2010/0293882 entitled "PRESSURE PLATE ASSEMBLY FOR CURTAIN WALL PANELS", the content of which is hereby incorporated by reference. Each vertical pressure plate 130 includes a first member 150 and a second member 152. Each horizontal pressure plate 132 includes a first member 154 and a second member 156. In the illustrated example, the first and second members 150, 1152 of the vertical pressure plate 130 are coupled to one another. The first and second members 154, 156 of the horizontal pressure plate 132 are coupled to one another. FIG. 15 shows the covers 140, 142 mounted on the pressure plates 130, 132 of FIG. 14.

Figure 16:
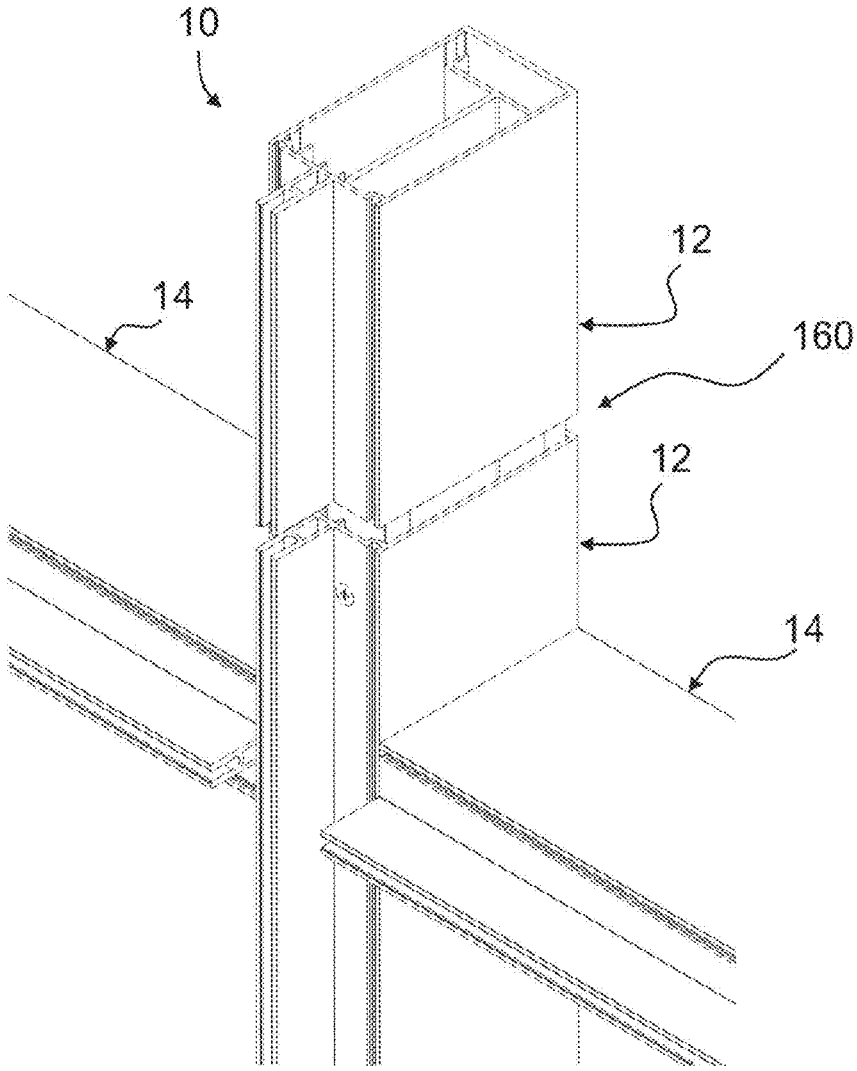
FIG. 16 is a view similar to FIG. 1 and illustrates an example of an expansion joint between two consecutive vertical existing mullions.
Figure 17:
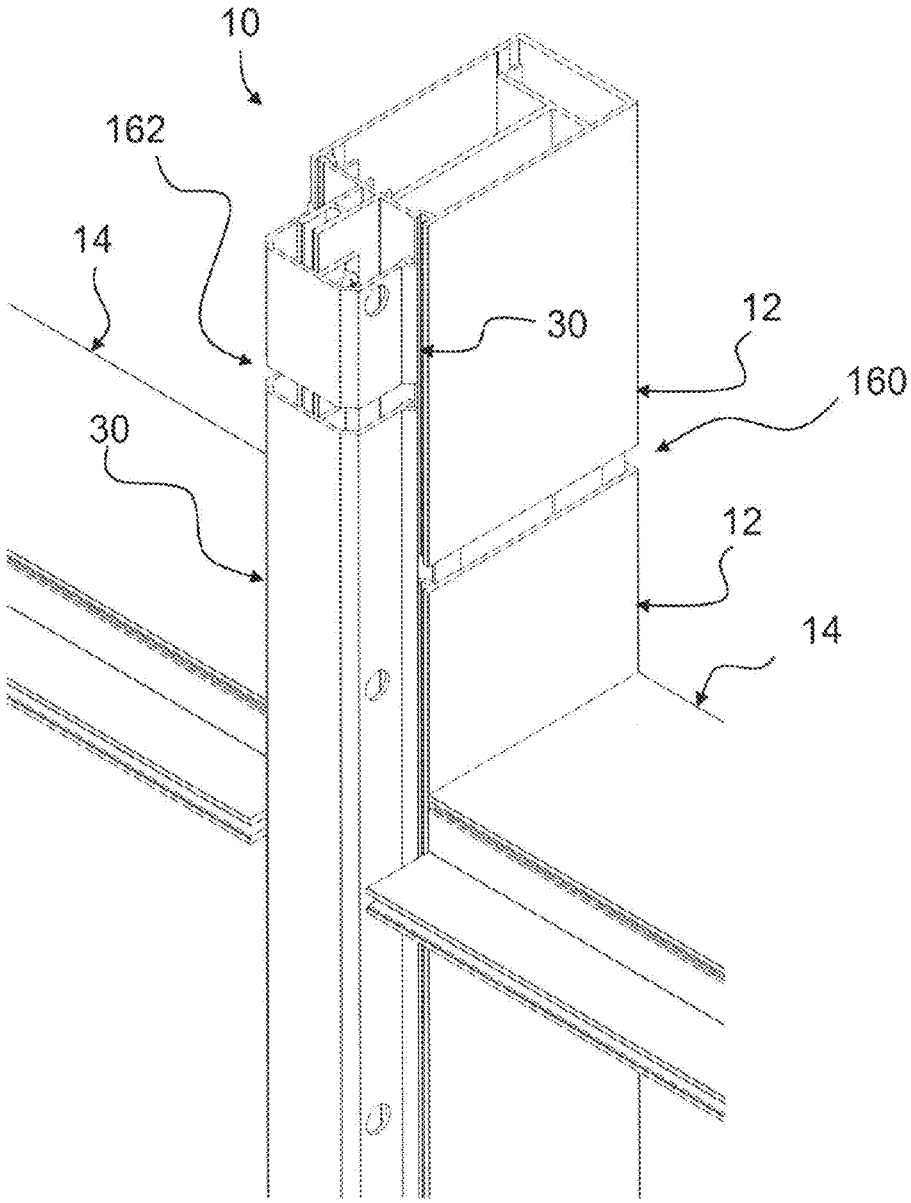
FIG. 17 is a view similar to FIG. 2 and illustrates an example of a vertical retrofit adaptor overlapping the expansion joint shown in FIG. 16.

FIG. 16 is a view similar to FIG. 1 and illustrates an example of a first expansion joint 160 between two consecutive vertical existing mullions 12. FIG. 17 is a view similar to FIG. 2 and illustrates an example of the vertical retrofit adaptor 30 overlapping the first expansion joint 160 shown in FIG. 16. As can be seen, another vertical retrofit adaptor 30 is positioned at a given distance from the first one to create a second expansion joint 162. Each vertical retrofit adaptor 30 is bolted or otherwise fastened to only one of the two consecutive vertical existing mullions 12.

Figure 18:
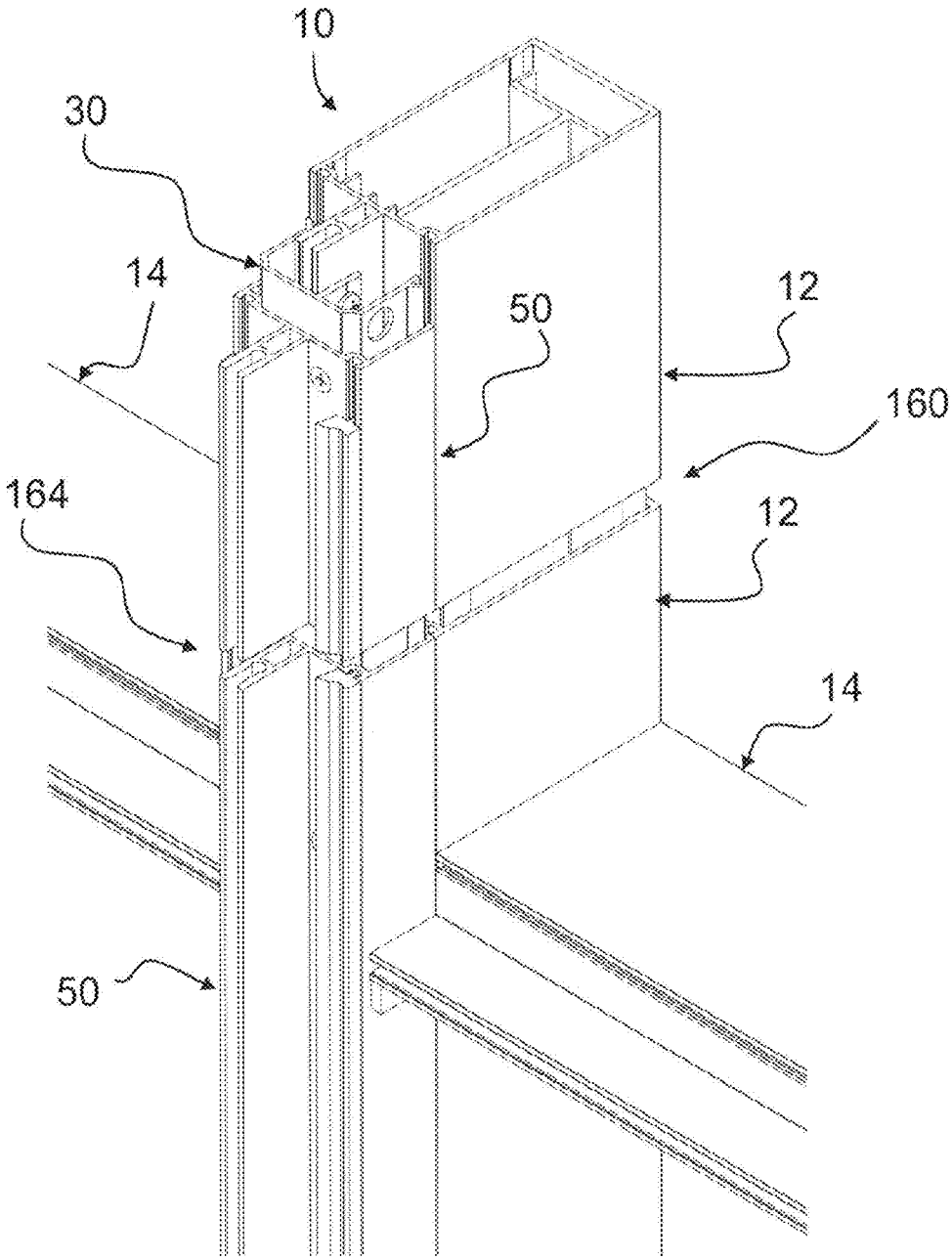
FIG. 18 is a view similar to FIG. 4 and illustrates an example of a vertical new mullion overlapping the expansion joint between two consecutive vertical retrofit adaptors shown in FIG. 17.

FIG. 18 is a view similar to FIG. 4 and illustrates an example of a vertical new mullion 50 overlapping the second expansion joint 162 shown in FIG. 17. It also shows that the end of the vertical new mullion 50 and the facing end of another vertical new mullion 50 can be positioned so as to be in registry with the corresponding ends of the vertical existing mullions 12 located right under. Other configurations and arrangements are also possible. An expansion joint 164 is provided between the two consecutive vertical new mullions 12.

Figure 19:
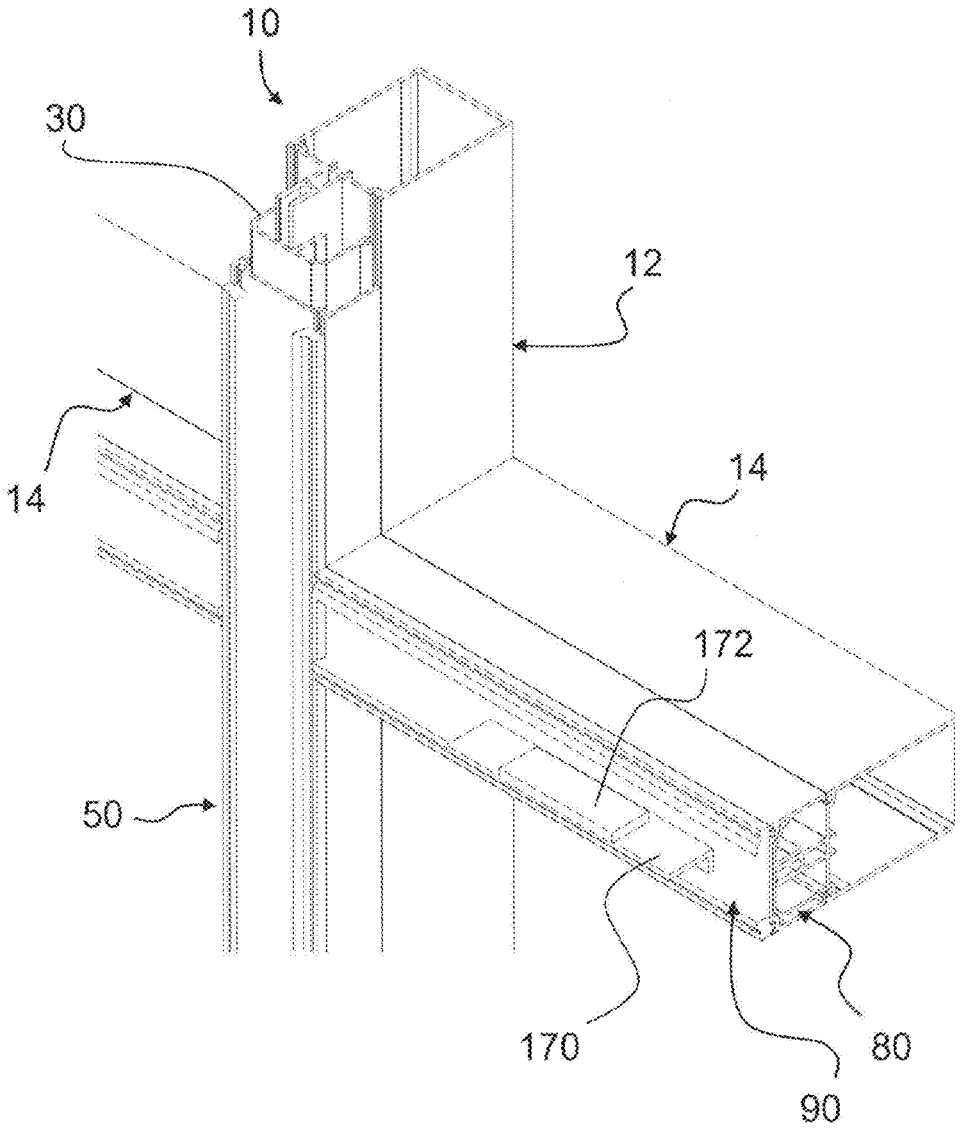
FIG. 19 is a view similar to FIG. 7 and illustrates other examples of vertical and horizontal new mullions.

FIG. 19 is a view similar to FIG. 7 and illustrates other examples of vertical and horizontal new mullions 50, 90. In this figure, the vertical new mullion 50 is devoid of a front flanged portion. Also, the horizontal new mullion 90 includes a plurality of front brackets 170, having a substantially L-shaped cross section, on which are provided one or more rectangular-shaped shims 172. These L-shaped front brackets 170 replace the front flanged portions of the previous examples.

Figure 20:
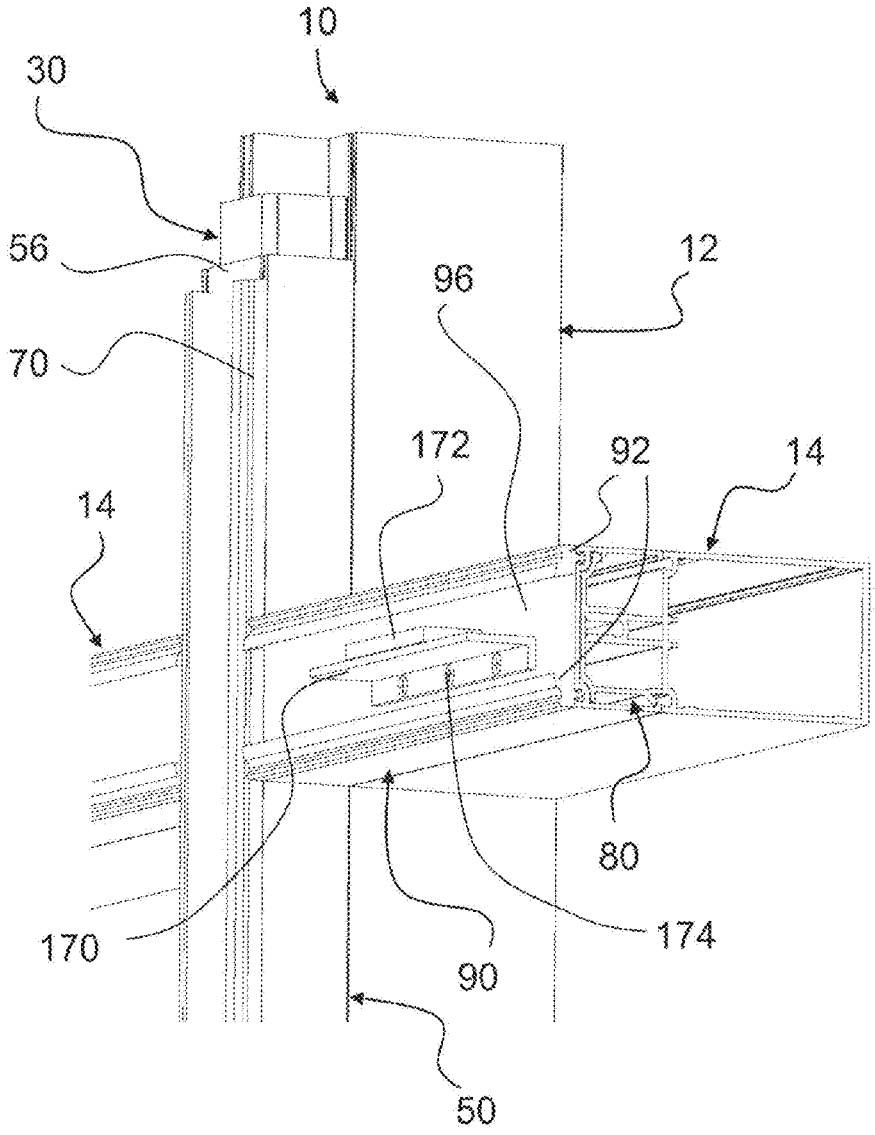
FIG. 20 is an isometric view illustrating the parts shown in FIG. 19 from another angle.

FIG. 20 is an isometric view illustrating the parts shown in FIG. 19 from another angle. It shows that the illustrated L-shaped front bracket 170 is connected to the front wall 96 of the horizontal new mullion 90 by screws 174. Other kinds of fasteners and arrangements are also possible.

Figure 21:
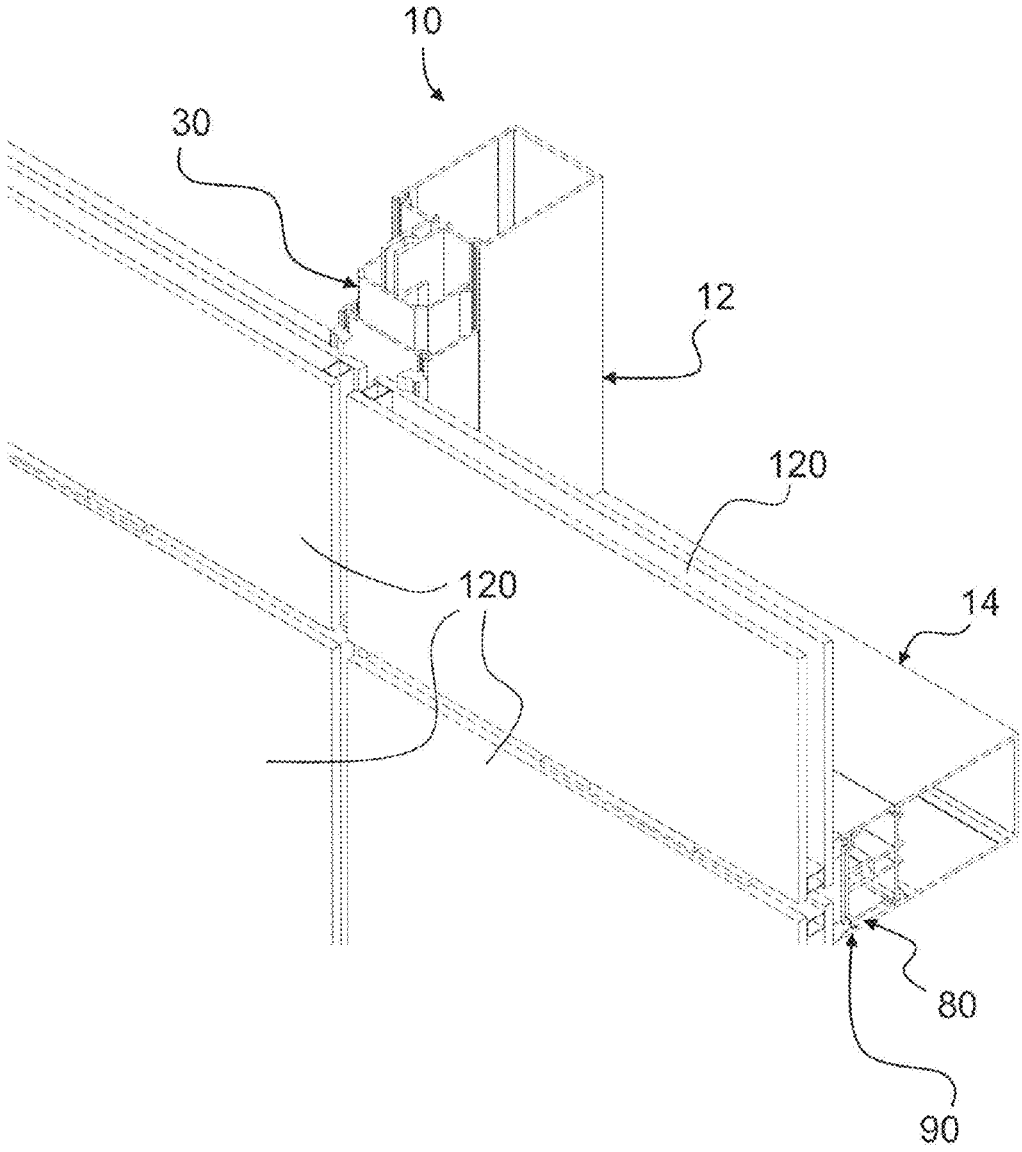
FIG. 21 is an isometric view illustrating an example of a set of panels supported by the horizontal new mullions shown in FIG. 19.

FIG. 21 is an isometric view illustrating an example of a set of panels 120 supported by the horizontal new mullions 90 shown in FIG. 19. Just before the installation of these panels 120, beads of structural silicone sealant were applied on the front wall 56 of the vertical new mullions 50 and on the front wall 96 of the horizontal new mullions 90 adjacent to the inner side of their respective gaskets 70, 92 (FIG. 20). The panels 120 were installed afterwards. Temporary pressure plates (not shown) can be secured to the horizontal new mullion 90 while the sealant cures. Once cured, the temporary pressure plates can be removed. Finishing beads of silicone are then applied between the panels 120, backed by backer rods for keeping the water out. Other configurations and arrangements are also possible.

Figure 22:
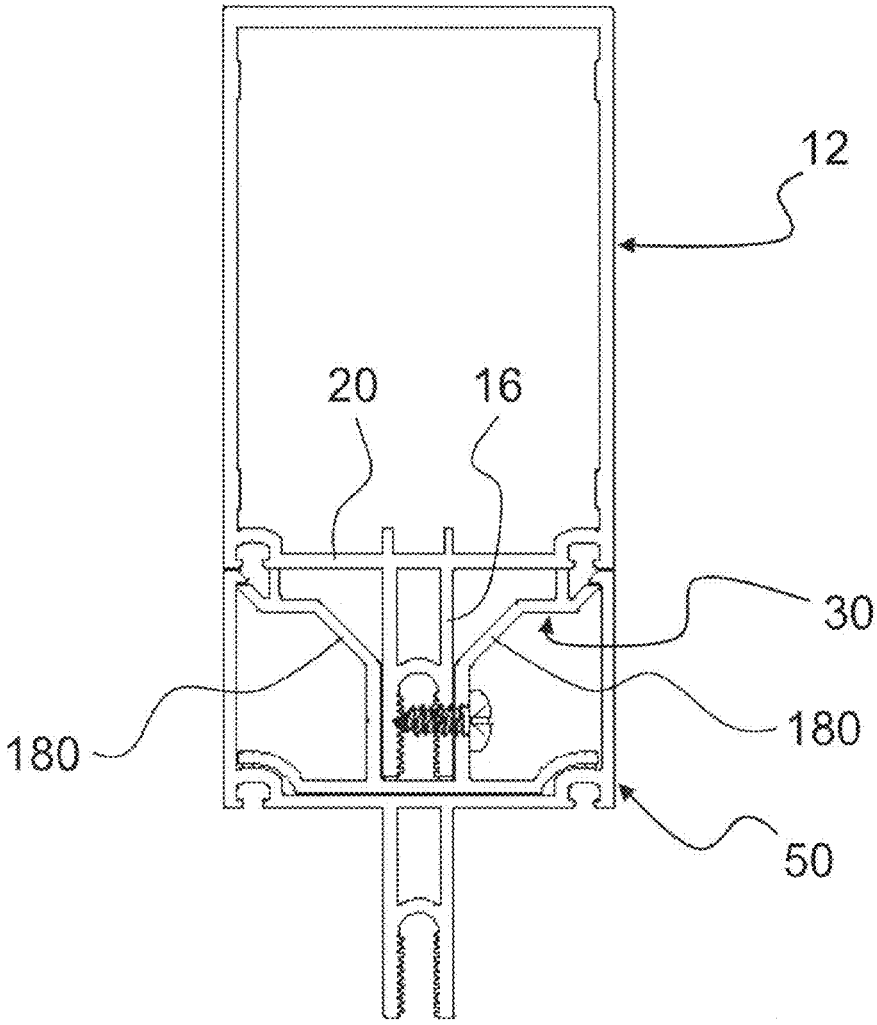
FIG. 22 is an end view illustrating another example of a vertical retrofit adaptor, inserted on the vertical existing mullion shown in FIG. 1, and on which the vertical new mullion of FIG. 4 is inserted.

FIG. 22 is an end view illustrating another example of a vertical retrofit adaptor 30. This vertical retrofit adaptor 30 is inserted on the vertical existing mullion 12 shown in FIG. 1. It includes obliquely-disposed walls 180. FIG. 22 also shows a vertical new mullion 50, similar to the one of FIG. 4, inserted on this vertical retrofit adaptor 30.

Figure 23:
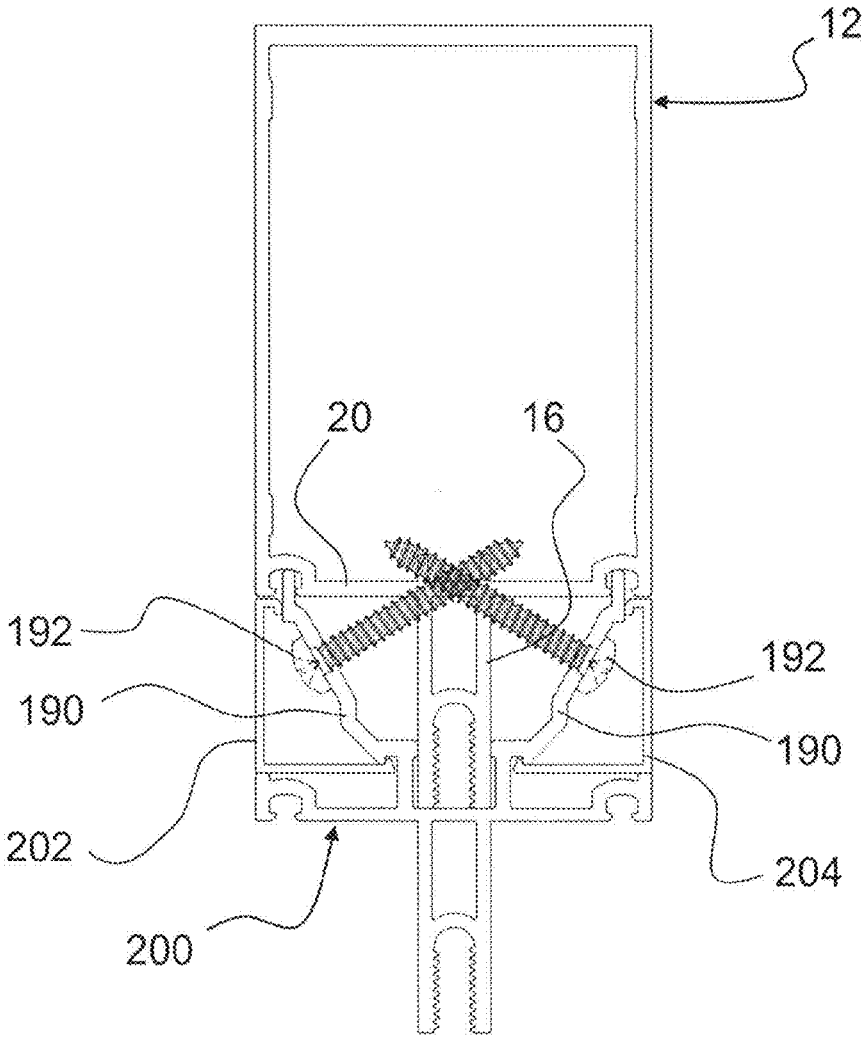
FIG. 23 is an end view illustrating a combined vertical retrofit adaptor and vertical new mullion inserted on the vertical existing mullion shown in FIG. 1.

FIG. 23 is a cross-sectional view illustrating an example of a combined vertical retrofit adaptor and vertical new mullion. The two are made integral with one another and form a monolithic part 200. The vertical retrofit adaptor is mounted on the vertical existing mullion 12 shown in FIG. 1. It includes obliquely-disposed walls 190 whose free ends are inserted into the grooves made on the front wall 20 of the vertical existing mullion 12. Spaced-apart screws 192 are inserted across the front flanged portion 16 and the front wall 20 of the vertical existing mullion 12 at various longitudinal positions to secure the part 200. Other kinds of fasteners and arrangements are also possible. Removable side covers 202, 204 form the side walls of the part 200.

Figure 24:
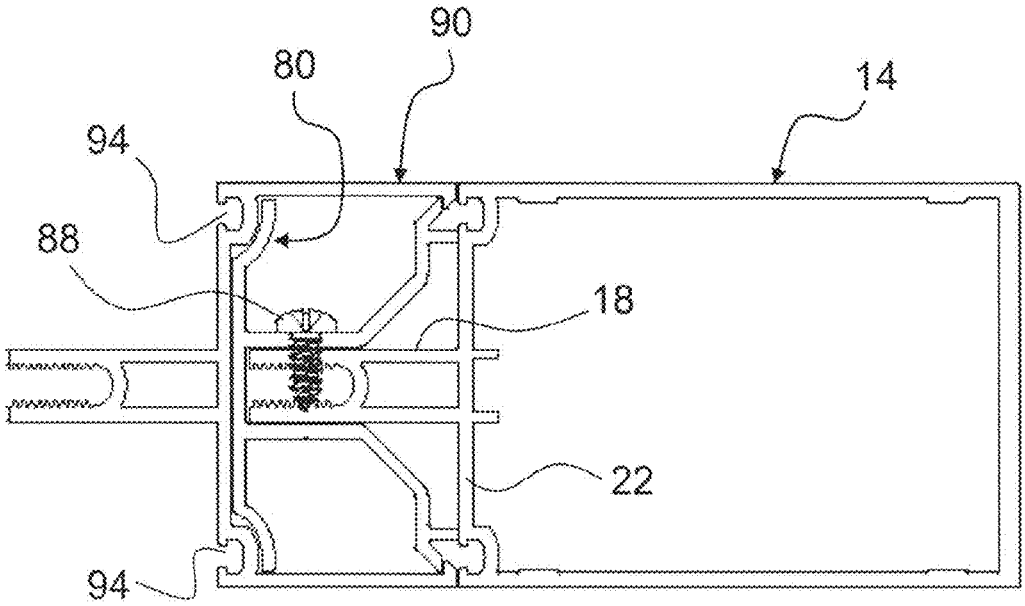
FIG. 24 is an end view illustrating another example of a horizontal retrofit adaptor, inserted on one of the horizontal existing mullions shown in FIG. 1, and on which a horizontal new mullion is inserted.

FIG. 24 is a cross-sectional view illustrating another example of a horizontal retrofit adaptor 80 inserted on one of the horizontal existing mullions 14 shown in FIG. 1. FIG. 24 also shows a horizontal new mullion 90, similar to the one of FIG. 7, inserted on this horizontal retrofit adaptor 80.

Overall, the proposed concept provides a method for refurbishing an existing curtain wall attached to a base structure. The method includes dismounting the existing curtain wall to expose a front side of the existing mullions while leaving them attached to the base structure, mounting retrofit adaptors to the front side of the existing mullions, and mounting new mullions to the retrofit adaptors. The new mullions form a plurality of new panel-receiving areas, each being adjacent to a corresponding one of the existing panel-receiving areas.

As can be appreciated, the system and the method of the proposed concept can significantly reduce the time and the costs for completely refurbishing an existing curtain wall 10 since the vertical and horizontal existing mullions 12, 14 can be used to anchor the vertical and horizontal new mullions 50, 90. The system and the method of the proposed concept can also significantly reduce the time and costs for refurbishing an existing curtain wall 10 in which only the panels, for instance glazing units, were initially considered to be replaced since no or only a very minimal cleaning of the existing supporting framework is then required before the installation of the new panels. The cost reductions and/or the overall advantages obtained with the system and method will generally be greater than the cost of making a thorough cleaning of the existing parts.

The present detailed description and the appended figures are meant to be exemplary only, and a skilled person will recognize that many changes can be made while still remaining within the proposed concept. The following paragraphs give examples of such changes but they are only a subset of all the possible changes and are presented in no particular order.

The various features of the illustrated examples can be combined differently and the shapes and/or the number of the parts can be different compared to what is shown and described. The proposed concept is not limited to the illustrated examples.

Materials can be different from those specifically mentioned in the present disclosure.

Fasteners do not necessarily need to be bolts or screws. Other kinds of fasteners are possible as well.

The illustrated existing mullions are only examples. The proposed concept can be used with other kinds of existing mullions. The use of the words "horizontal" and "vertical", or other related words and expressions, is not necessarily limitative. For instance, a curtain wall can be designed with oblique mullions.

It should be noted that the word "building" is used in the present application in a broad generic manner and may possibly cover constructions that are not always necessarily referred to as buildings by some persons.

The words "panel" and "panels" is used in the present application in a broad generic manner and includes glazing units as well as any other kinds of panels to be used in a curtain wall.

If desired, the existing curtain wall can be refurbished only by the addition of the system and the existing panels can be reused in the refurbished curtain wall.

Still, many other variants of the proposed concept will be apparent to a skilled person, in light of a review of the present description.

What is claimed is:

1. A method for refurbishing an existing curtain wall attached to a base structure, the curtain wall having a plurality of existing mullions forming a plurality of existing panel-receiving areas, the method including:

dismounting the existing curtain wall to expose a front side of the existing mullions while leaving them attached to the base structure;

mounting retrofit adaptors to the front side of the existing mullions; and mounting new mullions to the retrofit adaptors, the new mullions forming a plurality of new panel-receiving areas, each being adjacent to a corresponding one of the existing panel-receiving areas, wherein at least some among the retrofit adaptors overlap expansion joints between two consecutive mullions among the existing mullions.

2. The method as defined in claim 1, wherein each of the retrofit adaptors overlapping one of the expansion joints is rigidly connected to only one of the corresponding two consecutive mullions.

3. The method as defined in claim 1, wherein attaching the retrofit adaptors to the front side of the existing mullions includes leaving a first expansion joint between each two consecutive retrofit adaptors, and attaching the new mullions to the retrofit adaptors includes leaving a second expansion joint between each two consecutive new mullions, each first expansion joint being overlapped by one of the new mullions.

* * * * *